US010435119B2

(12) United States Patent
Ruivenkamp

(10) Patent No.: US 10,435,119 B2
(45) Date of Patent: Oct. 8, 2019

(54) CONTAINER CATCHING SYSTEM WHICH IS SEA-PROOF

(71) Applicant: Hallcon B.V., Eb Maasland (NL)

(72) Inventor: Johan Ruivenkamp, Eb Maasland (NL)

(73) Assignee: Hallcon B.V., Eb Maasland (NL)

( * ) Notice: Subject to any disclaimer, the term of this patent is extended or adjusted under 35 U.S.C. 154(b) by 0 days.

(21) Appl. No.: 15/784,888

(22) Filed: Oct. 16, 2017

(65) Prior Publication Data

US 2018/0105233 A1 Apr. 19, 2018

(30) Foreign Application Priority Data

Oct. 18, 2016 (NL) ..... 2017631

(51) Int. Cl.

| | |
|---|---|
| ***B63B 25/00*** | (2006.01) |
| ***B63B 27/16*** | (2006.01) |
| ***B63B 25/28*** | (2006.01) |
| ***B65D 88/78*** | (2006.01) |
| ***B63B 27/30*** | (2006.01) |
| ***B63B 38/00*** | (2006.01) |
| ***B66C 1/10*** | (2006.01) |

(Continued)

(52) U.S. Cl.

CPC ..... *B63B 27/16* (2013.01); *B63B 25/004* (2013.01); *B63B 25/28* (2013.01); *B63B 27/30* (2013.01); *B63B 38/00* (2013.01); *B65D 88/129* (2013.01); *B65D 88/78* (2013.01); *B66C 1/101* (2013.01); *B66C 1/223* (2013.01); *B63B 2025/285* (2013.01)

(58) Field of Classification Search

CPC ..... B63B 27/16; B63B 25/28; B63B 27/30; B63B 25/004; B63B 38/00; B63B 2025/285; B65D 88/129; B65D 88/78; B66C 1/223; B66C 1/101

USPC ..... 414/137.1–143.2

See application file for complete search history.

(56) References Cited

U.S. PATENT DOCUMENTS 3,444,829 A * 5/1969 Mork ..... B65D 19/14 108/53.3
3,499,398 A * 3/1970 Murray ..... B65D 19/385 108/53.5

(Continued)

FOREIGN PATENT DOCUMENTS

| | | |
|---|---|---|
| DE | 198 22 565 A1 | 11/1999 |
| FR | 2 552 381 | 3/1985 |
| WO | WO 2015/149439 A1 | 10/2015 |

OTHER PUBLICATIONS

European Search Report dated Jul. 5, 2017 in Dutch application 2017631, filed on Oct. 18, 2016 (with English Translation of Categories of Cited Documents and Written Opinion).

*Primary Examiner* — Lynn E Schwenning
(74) *Attorney, Agent, or Firm* — Oblon, McClelland, Maier & Neustadt, L.L.P.

(57) ABSTRACT

A container catching system, which is sea proof, includes a frame with a base on which a container is to be positioned, hinge pins secured to the frame above the base, and arms situated around the base, each arm having an abovementioned hinge pin. Arm portions situated above the hinge pin contact, in the unfolded state, a container to be lowered to guide the container towards the base, and arm portions situated below the hinge pin move outwards when they contact the container, thereby causing at least the top arm to engage the container.

10 Claims, 3 Drawing Sheets

Figure 1:
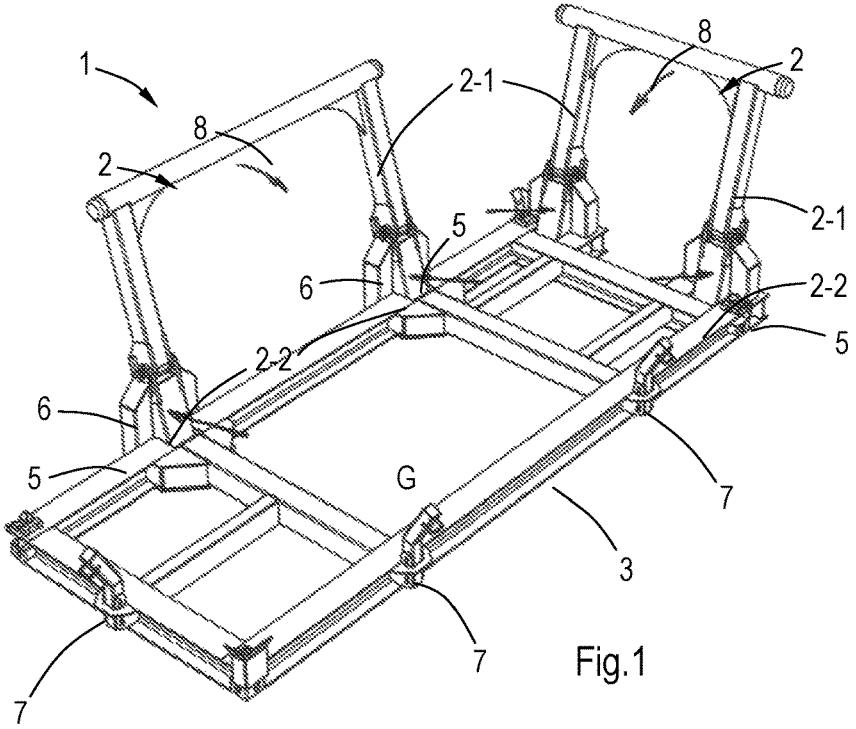

(51) Int. Cl.
*B66C 1/22* (2006.01)
*B65D 88/12* (2006.01)

(56) References Cited

U.S. PATENT DOCUMENTS

| | | | | | |
|---|---|---|---|---|---|
| 3,776,169 | A | | 12/1973 | Strecker | |
| 3,894,640 | A | * | 7/1975 | Crooke | B63B 27/08 114/259 |
| 5,171,113 | A | * | 12/1992 | Hove | B61D 45/008 248/602 |
| 5,603,598 | A | * | 2/1997 | Hasegawa | B66C 13/06 212/272 |
| 6,056,498 | A | * | 5/2000 | Velinsky | E01F 9/70 414/501 |
| 6,604,904 | B2 | * | 8/2003 | Takehara | B65G 63/004 212/270 |
| 9,308,973 | B2 | * | 4/2016 | Teppig, Jr. | B63B 27/36 |
| 2003/0108405 | A1 | * | 6/2003 | Takehara | B65G 63/004 414/140.3 |
| 2004/0261686 | A1 | * | 12/2004 | Mears | B63B 43/14 114/360 |
| 2010/0115853 | A1 | * | 5/2010 | Gebhart | H02P 6/085 49/506 |
| 2010/0135742 | A1 | * | 6/2010 | Sain | B65D 88/12 410/46 |
| 2010/0294785 | A1 | * | 11/2010 | Massa | B65D 88/129 220/666 |
| 2011/0155025 | A1 | * | 6/2011 | Reynard | B65D 88/129 108/55.1 |

* cited by examiner

CONTAINER CATCHING SYSTEM WHICH IS SEA-PROOF

The present invention relates to a container catching system which is sea proof and the use thereof on board ships.

It is an object of the present invention to provide a more universal, but also safely applicable, sea-proof container catching system, which can be used also in rough weather conditions at sea to bring containers, in particular sea containers, on board of a ship in a safe manner and secure them in situ.

To achieve this, the container catching system which is sea proof according to the invention comprises:

- a frame with a base on which a container is to be positioned,
- hinge pins secured to the frame above the base, and
- arms situated around the base, each arm having an above-mentioned hinge pin, wherein arm portions situated above said hinge pin contact, in the unfolded state, a container to be lowered to guide the container towards the base, and arm portions situated below the hinge pin move outwards when they contact the container, thereby causing at least the top arm to engage the container.

An advantage of the invention resides in that the hinged arms can be moved at least away from each other, thus allowing a container to be manoeuvred relatively easily within the area bounded by said arms, in order to be guided eventually to a predetermined position on the base between the arms. By virtue thereof, the invention can be used in a safe manner in turbulent water such as at sea, without the intervention of deck personnel, for example for lifting containers from and/or eventually placing them on deck of a supply vessel. In particular when the top arm portions are in the unfolded state when the container is being lowered, the outward extending top arm portions located above the hinge pin and a bottom angle profile of the lowered container contact one another. As a result, these arm portions guide the container towards the base. And when the container is lowered further, the container descends in a previously determined manner in the direction of the predetermined position on the base. When the angle profile of the container passes the hinge pin, contact is made with the arm portion situated below the hinge pin, which arm portion acts as a laterally movable cam, which causes in particular the top portion of the relevant arm, acting as a wall guide, to engage the side wall of the container when the latter is lowered accurately on to the base by the eventually fully vertical arm.

The power necessary to make the relevant top arm portion hinge is provided purely mechanically, as described hereinabove, by the container contacting the bottom arm portion and thereby moving said bottom arm portion. Consequently, additional energy-consuming measures, such as actuators, are not required to enclose the container in the predetermined position between the arms.

An embodiment of the container catching system is characterized according to the invention in that neighbouring arms are connected to one another by means of girders.

By connecting the arms to one another, and by being hinged, said interconnected arms become mechanically stronger, enabling them to better take up the substantial impact forces caused by swinging containers without damage being caused.

A further embodiment of the container catching system is characterized according to the invention in that at least the arm portions located above the hinge pin can be folded such that they are close to the base.

This has the advantage that the container system can be folded flat and takes up little space, allowing in principle a plurality of frames to be stacked on top of one another. In addition, if necessary, one or more frames can be transported simultaneously, wherein the bottom frame of the stack can be mounted on a vehicle or a vessel.

Further detailed, possible embodiments explained in the other claims are mentioned, together with the associated advantages, in the following description.

The container catching system which is sea proof according to the present invention will now be explained in greater detail with reference to the figures mentioned below, in which corresponding elements are indicated by means of the same reference numerals.

Figure 2A:
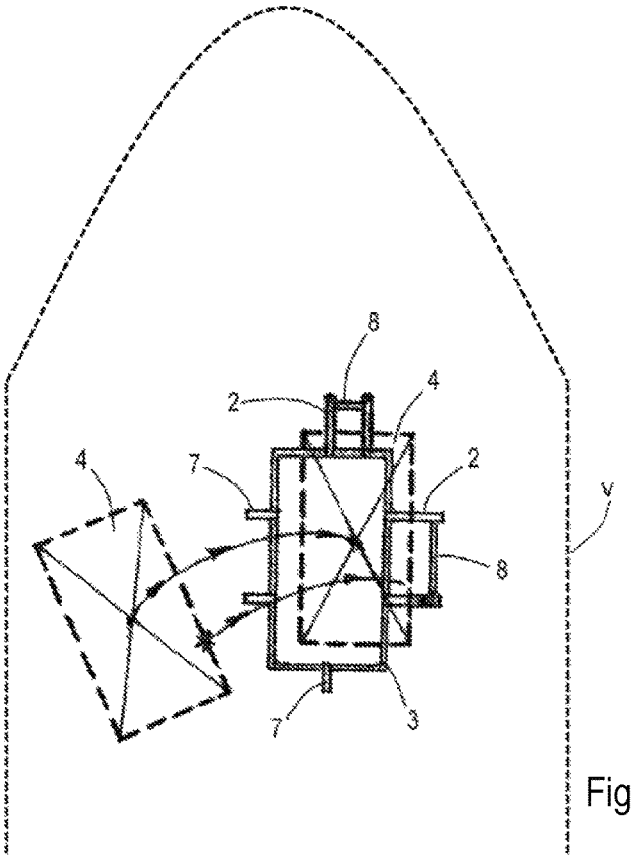
Figure 2B:
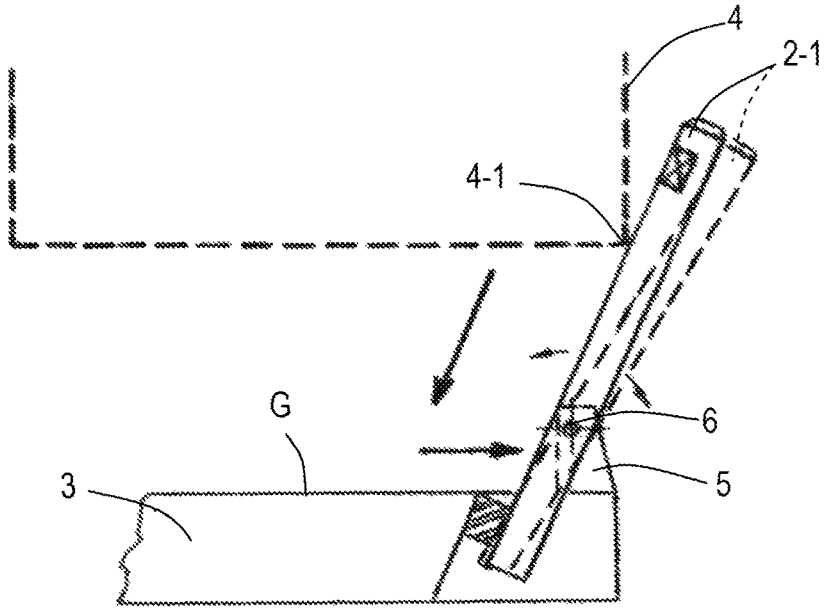
Figure 3:
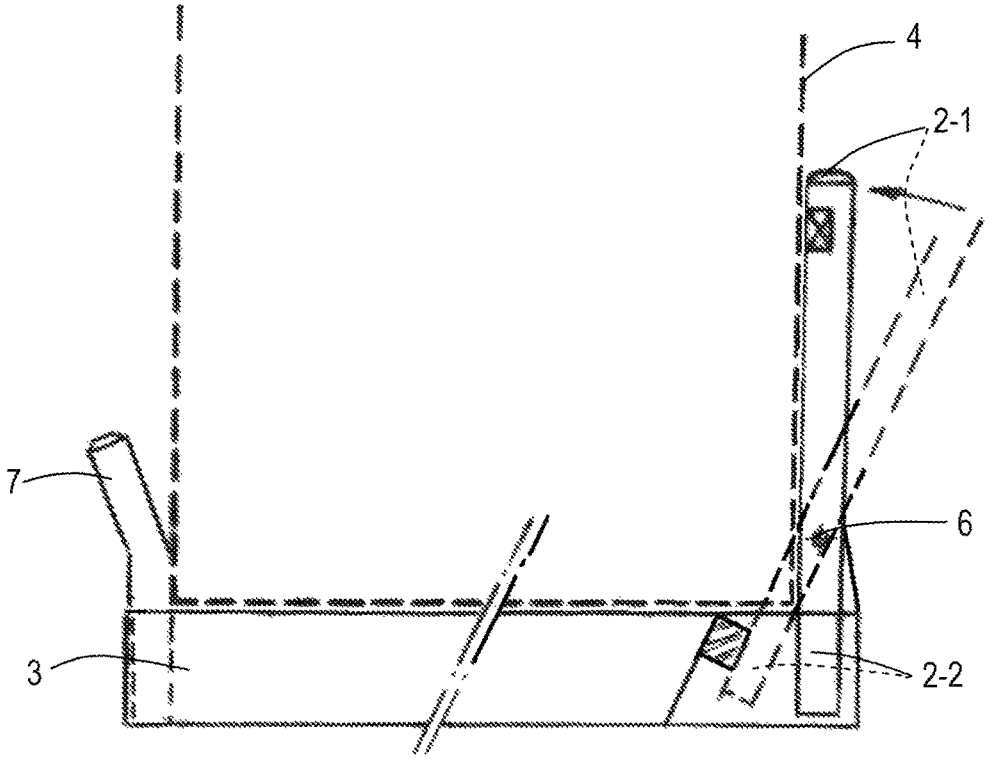

In the figures:

FIG. 1 shows an embodiment of the system according to the invention comprising hinged arms;

FIGS. 2*a* and 2*b* show possible subsequent positions of a container lowered between the arms; and FIG. 3 is a side view of the system according to the invention, wherein the container is positioned on the base.

Figure 4:
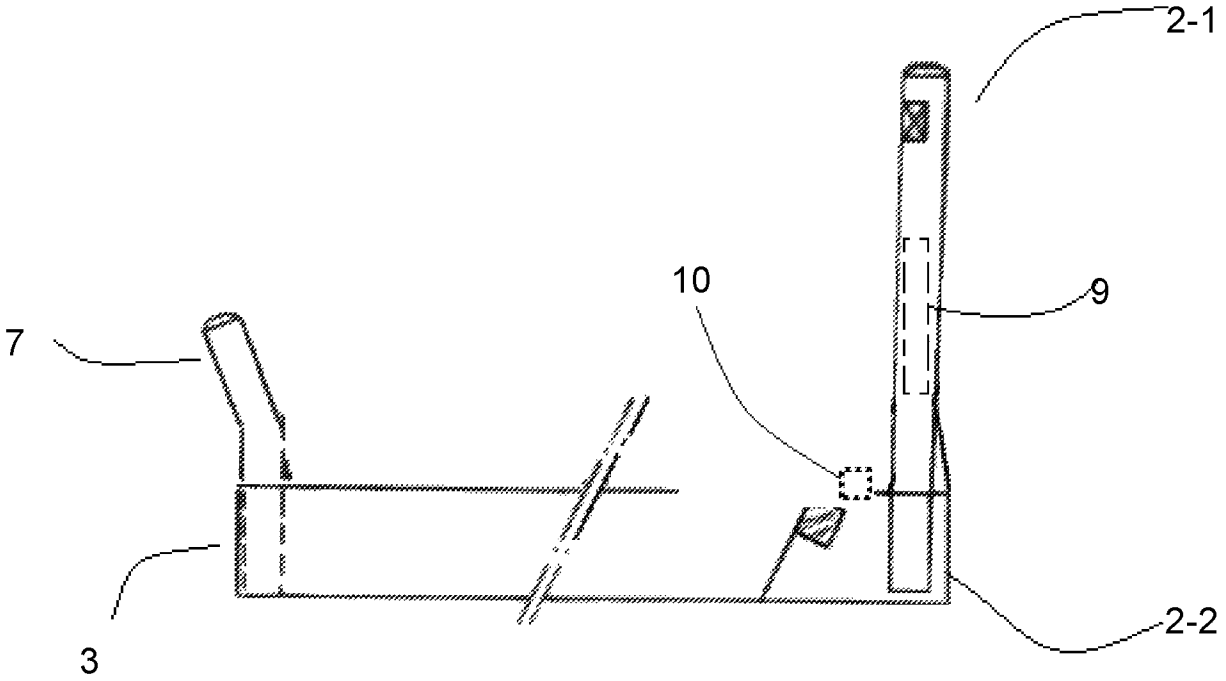

FIG. 4 is a side view of the system according to the invention, wherein the arm includes an actuator and a sensor.

FIG. 1 shows a container catching system 1 which is sea proof, comprising arms 2 which can move in the direction of the arrows and in the opposite direction, said arms being secured on a frame 3. Said frame 3 has a base G which is dimensioned such that a container 4 can be positioned on the frame. Around the frame 3, raised portions 5 are provided in which hinge pins 6 can be rotated which form part of the arms 2 which can hinge about the pins 6. Said pins 6 of the hinged arms 2 are located above the base G. Each hinged arm 2 has a top arm portion 2-1 and a bottom arm portion 2-2 which can be rigidly interconnected by means of a controllable latch, not shown in the figures, enabling them to swing about the joint hinged pin 6.

If the arm portion 2-1, which is located above the hinge pin 6, is in the unfolded state, as shown in FIG. 2*a*, it contacts the container 4 being moved towards said arm portion, and subsequently it guides the container in the direction of the downward arrow towards the base G. If the shown angle profile 4-1 of the container, i.e., where the walls of the container 4 meet, passes the hinge pin and contacts the arm portion 2-2 located below the hinge pin, said arm portion is moved outwards.

On the opposite side of the frame 3, one or more short arms 7, shown in FIGS. 1 and 3, are located which are bent outwards and which are fixedly, yet often removably, secured to the frame 3, and which in combination with the bottom arm portion 2-2 guide the descending container. These shorter catching arms 7, which are located on the input side of the containers 4 passing said arms above the base, help to achieve that the arm portion 2-2 is made to move outwards by the descending container.

The outward moving bottom arm portion 2-1 ensures that the top arm portion 2-1 and eventually the arm as a whole engages, in this case the right-hand side of, the container, so that the container can be positioned in a stable and enclosed manner on the base G.

FIG. 1 further shows that neighbouring arms 2 are connected to one another by means of girders 8. By virtue thereof, one or more stable fences are formed around the perimeter of the base G, which are capable of taking up relatively large impacts which occur in particular when a container 4 contacts the respective arms for the first time.

The system 1 is compact if the arm portions 2-1 located above the hinge pin 6 can be folded such that they are close to the base G. By means of the abovementioned latch, the portions 2-1 and 2-2 are disconnected, enabling the hinged portions 2-1 to hinge individually such that they are flat on the frame 3. If required, a bottom surface of the frame 3 can be mounted on a vehicle or a vessel V, if the portions 2-1 are folded, and subsequently it can be transported in compact form.

Advantageously, an electric energy supply, or provisions for pneumatics or hydraulics can be dispensed with, because the above described purely mechanical measures are sufficient to make the arms 2 hinge. Depending on the circumstances, however, the container catching system 1 may comprise electrical, mechanical, electromechanical, pneumatic or hydraulic actuators 9, which are connected to the aims 2 for hinge movement of the arms 2, 2-1, and which may or may not be sensor controlled by sensor 10. In this case, the arm portions 2-2 only have to be cams of switches which, together with other means, control said actuators. And the top arm portion 2-1 can then be hinged individually by the actuator at the command of the cam, which may or may not be depressed.

The sea-proof container catching system 1 can preferably be used to hoist containers 4, in particular rescue containers for personnel or other applications, sea containers and/or service containers, on or from board a vessel provided with the container catching system.

If required, well-known corner fittings are provided on the frame 3 to lock the container 4 on the base G.

The invention claimed is:

1. A sea-proof container catching system comprising: a frame that includes:

a base on which a container is receivable, and a plurality of hinged arms extending from the base, each hinged arm including:

a hinge located above the base;

an upper arm portion situated above the hinge which, in an unfolded state, is to contact and guide the container towards the base; and a lower arm portion situated below the hinge which moves outwards when contacted by the container, thereby causing at least the upper arm portion to rotate about the hinge and engage the container; and wherein the plurality of hinged arms are disposed on adjacent sides of the base.

2. The sea-proof container catching system according to claim 1, wherein at least two hinged arms of the plurality of hinged arms are connected to one another by girders.

3. The sea-proof container catching system according to claim 1, wherein the upper arm portions are rotatable toward the base.

4. The sea-proof container catching system according to claim 1, wherein a surface of the frame is mountable on a vehicle or a vessel.

5. The sea-proof container catching system according to claim 1, wherein the sea-proof container catching system comprises electrical, mechanical, electromechanical, pneumatic or hydraulic actuators, which are connected to the hinged arms to provide movement of the hinged arms.

6. The sea-proof container catching system according to claim 5, wherein the movement of the hinged arms is controlled by a sensor.

7. The sea-proof container catching system according to claim 1, further comprising a plurality of shorter arms extending from the base, the plurality of shorter arms being shorter than the plurality of hinged arms, and wherein each shorter arm of the plurality of shorter arms is removably fixed to the base.

8. The sea-proof container catching system according to claim 7, wherein the plurality of shorter arms include end portions which extend outwardly above the base.

9. A method, comprising:

using the sea-proof container catching system according to claim 1 to secure a container, including a rescue container, a sea container, and/or a service container, on a vessel mounted with the container catching system.

10. A sea-proof container catching system comprising: a frame that includes:

a base on which a container is receivable, and a plurality of hinged arms extending from the base, each hinged arm including:

a hinge located above the base, an upper arm portion situated above the hinge which, in an unfolded state, is to contact and guide the container towards the base: and a lower arm portion situated below the hinge which moves outwards when contacted by the container, thereby causing at least the upper arm portion to rotate about the hinge and engage the container; and the sea-proof container catching system further comprising an input side of the base, along which the container passes over to be positioned onto the base; and a plurality of shorter arms extending from the input side of the base, the plurality of shorter arms being shorter than the plurality of hinged arms.

* * * * *